US006209165B1

(12) United States Patent
Frolova

(10) Patent No.: US 6,209,165 B1
(45) Date of Patent: Apr. 3, 2001

(54) HAND-HELD DEVICE FOR SCRUBBING A PART THEREWITH AND FOR CAPTURING A WASHING ARTICLE THEREIN

(76) Inventor: Tatyana Frolova, 2142 E. 8th St. #4, Brooklyn, NY (US) 11223

( * ) Notice: Subject to any disclaimer, the term of this patent is extended or adjusted under 35 U.S.C. 154(b) by 0 days.

(21) Appl. No.: 09/498,969

(22) Filed: Feb. 7, 2000

(51) Int. Cl.[7] ..... A47K 7/02
(52) U.S. Cl. ..... 15/222; 401/8; 401/201
(58) Field of Search ..... 15/222; 401/8, 401/201; 601/137, 136

(56) References Cited

U.S. PATENT DOCUMENTS

| | | | | |
|---|---|---|---|---|
| 1,404,401 | * | 1/1922 | Novick | 401/201 |
| 1,598,574 | * | 8/1926 | Gibson | 401/201 |
| 3,124,827 | * | 3/1964 | Hull | 15/222 |
| 3,674,374 | * | 7/1972 | Jennings | 401/201 |
| 3,720,205 | * | 3/1973 | Liebman | 401/201 |
| 3,812,849 | | 5/1974 | Giunta . | |
| 3,959,841 | * | 6/1976 | Horne | 15/222 |
| 3,977,796 | | 8/1976 | Gillespie et al. . | |
| 4,582,625 | | 4/1986 | George . | |
| 5,295,280 | | 3/1994 | Hudson et al. . | |
| 5,537,709 | | 7/1996 | Taragos . | |
| 5,545,456 | | 8/1996 | Suida . | |
| 5,671,498 | * | 9/1997 | Martin | 15/222 |
| 5,802,659 | | 9/1998 | Chang . | |
| 5,850,662 | | 12/1998 | Galvan-Garza . | |
| 6,047,433 | * | 4/2000 | Chang | 401/8 |
| 6,048,407 | * | 4/2000 | Schoch | 401/201 |

FOREIGN PATENT DOCUMENTS

| | | | | |
|---|---|---|---|---|
| 2491318 | * | 4/1982 | (FR) | 401/201 |
| 14478 | * | 7/1905 | (GB) | 15/222 |

* cited by examiner

*Primary Examiner*—Randall E. Chin
(74) *Attorney, Agent, or Firm*—Richard L. Miller, P.E.

(57) ABSTRACT

A hand-held device for scrubbing a body part therewith and for capturing a washing article, such as, but not limited to, a bar of soap, a wash cloth, or even both, therein. The device includes a body that is slender, elongated, generally rectangular-parallelepiped-shaped, has a pair of ends for grabbing by the hands of a user, a length, a width, an abrasiveness, is tubular for capturing the washing article therein, and the pair of ends thereof are open for inserting and removing the washing article therein and therefrom. The body includes a first plurality of threads that are flexible nylon, parallel to, and spaced-apart from, each other, and run longitudinally along the length thereof, and a second plurality of threads that are flexible nylon, parallel to, and spaced-apart, from each other, and run laterally around the width thereof. The first plurality of threads intersect the second plurality of threads, at intersection points, so as define an orthogonal matrix of openings therethrough for utilization of the washing article. The first plurality of threads and the second plurality of threads are attached to each other, by knots, at the intersection points thereof for facilitating capturing of the washing article in the body by engaging therewith and for increasing the abrasiveness of the body.

9 Claims, 1 Drawing Sheet

FIG.1
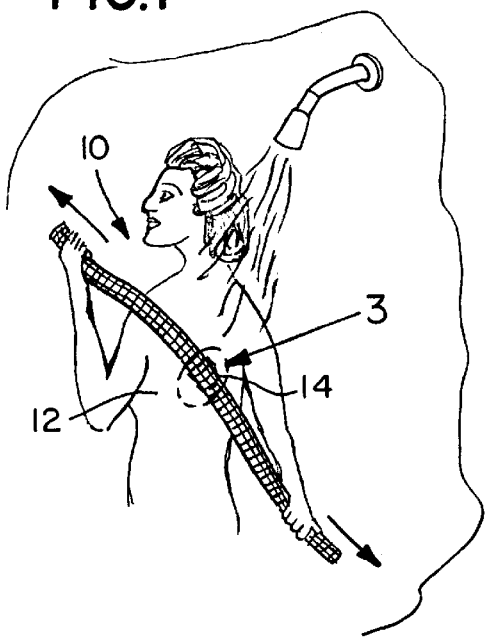
FIG.3
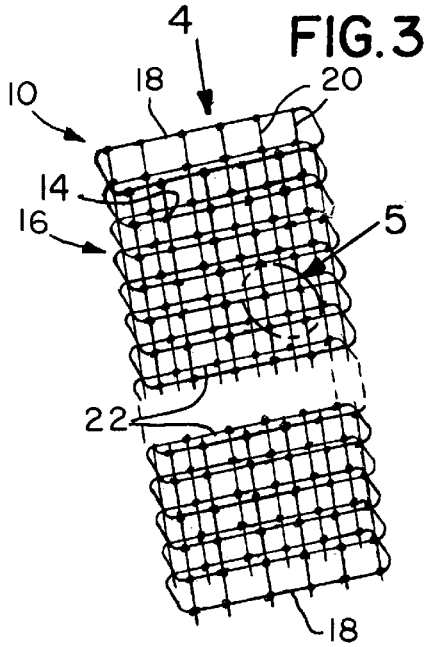
FIG.2
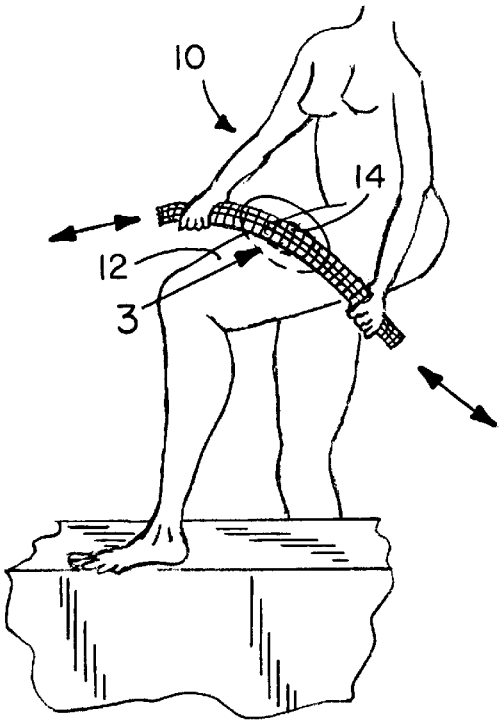
FIG.4
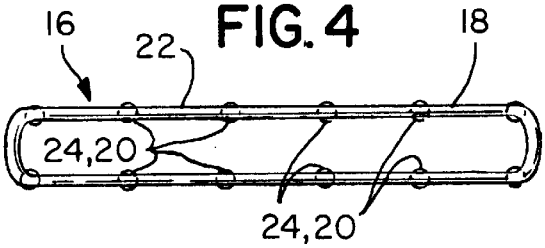
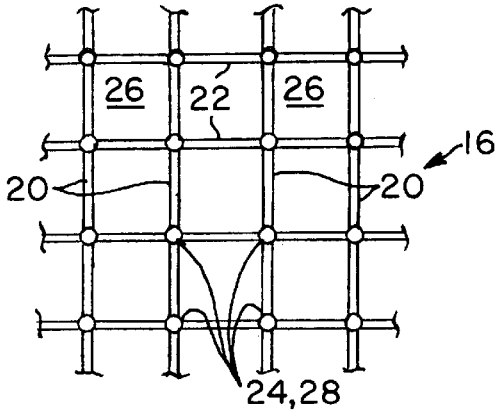
FIG.5

HAND-HELD DEVICE FOR SCRUBBING A PART THEREWITH AND FOR CAPTURING A WASHING ARTICLE THEREIN

BACKGROUND OF THE INVENTION

1. Field of the Invention

The present invention relates to a hand-held device for scrubbing a body part. More particularly, the present invention relates to a hand-held device for scrubbing a body part therewith and for capturing a washing article therein.

2. Description of the Prior Art

Numerous innovations for body washing devices have been provided in the prior art that will be described. Even though these innovations may be suitable for the specific individual purposes to which they address, however, they differ from the present invention.

A FIRST EXAMPLE, U.S. Pat. No. 3,812,849 to Giunta teaches a skin conditioning article that has a springy and pliable body of layers of nylon net fabric with a mesh of about one-eighth inch, more or less. In the illustrated embodiment, the body is elongated and has four layers of fabric gathered at either end to form necks and pleats. The fabric is first doubled upon itself to form a folded end edge. Both sides of the fabric are then doubled over to form a pair of folded side edges and open edges proximate each other at the center of one face of the body. The layers are secured to each other in any suitable manner, as by stitching, proximate each of the opposite ends of the body, and this stitching may also secure ties to the body for gathering the layers and forming the pleats and necks. The open edges of the body layers provide access to a pocket, formed by the folded end edge of the body, for retaining a bar of soap or other suitable article. The skin may be lubricated and the net fabric rubbed over the skin to cleanse and condition the skin.

A SECOND EXAMPLE, U.S. Pat. No. 3,977,796 to Gillespie et al. teaches two pieces of nylon net of predetermined dimensions that are superimposed on a piece of terry cloth of the predetermined dimensions. The terry cloth and nylon combination is folded over on itself to form a strip-like configuration in a manner whereby the net is on the outside. Each of a pair of handle members is affixed to a corresponding end of the strip-like configuration of terry cloth and nylon.

A THIRD EXAMPLE, U.S. Pat. No. 5,295,280 to Hudson et al. teaches a washing device for scrubbing the body that includes an elongate washing member formed of a plurality of inter-looped quadrate or box-like links. The gripping handles in the form of loops are connected to the end-most links of the chain-like washing member. Each link is formed of a tube gathered along its axis to provide a plurality of circular or cylindrical undulating layers spaced from each other in a radial direction. The length of the tube and the number of layers are selected to provide a desired width of the loop and to substantially fill the loop in the radial direction when in a relaxed condition. Preferably, the links are formed of fine polymeric filaments arranged in an open netting mesh, such a polyethylene netting.

A FOURTH EXAMPLE, U.S. Pat. No. 5,295,280 to Hudson et al. teaches a bath scrubber that is composed of a main body, a plurality of first lashing members, and two fastening members. The main body is formed of a plurality of cylindrical netlike unit members. The first lashing members are disposed between two unit members. The fastening members are located at both ends of the main body. The unit members have a first portion and a second portion, which are connected by a second lashing member. The bath scrubber is somewhat flattened to increase its contact area with the skin of a bather.

A FIFTH EXAMPLE, U.S. Pat. No. 5,850,662 to Galvan-Garza teaches an elastic plastic scrubber for the bath, which has one or more sections, each one being a tubular element, into which strings or pulls are inserted so that it is possible to rub one's entire back with little effort. A mop placed between two sections retains powdered soap, liquid soap or a tablet of solid soap, in such a way that the person using the scrubber can soap those areas of his body which are normally out of his reach. The method of manufacturing introduces a cylindrical post placed inside an elastic tube that will form the body of the scrubber. At the sides of the post and placed between the body and the post are one or two strings that when stretched out, will reduce the body's length and pleat the same to form a body called a "pumpkin".

It is apparent that numerous innovations for body washing devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hand-held device for scrubbing a body part therewith and for capturing a washing article therein that avoids the disadvantages of the prior art.

ANOTHER OBJECT of the present invention is to provide a hand-held device for scrubbing a body part therewith and for it capturing a washing article therein that is simple and inexpensive to manufacture.

STILL ANOTHER OBJECT of the present invention is to provide a hand-held device for scrubbing a body part therewith and for capturing a washing article therein that is simple to use.

BRIEFLY STATED, YET ANOTHER OBJECT of the present invention is to provide a hand-held device for scrubbing a body part therewith and for capturing a washing article, such as, but not limited to, a bar of soap, a wash cloth, or even both, therein. The device includes a body that is slender, elongated, generally rectangular-parallelepiped-shaped, has a pair of ends for grabbing by the hands of a user, a length, a width, an abrasiveness, is tubular for capturing the washing article therein, and the pair of ends thereof are open for inserting and removing the washing article therein and therefrom. The body includes a first plurality of threads that are flexible nylon, parallel to, and spaced-apart from, each other, and run longitudinally along the length thereof, and a second plurality of threads that are flexible nylon, parallel to, and spaced-apart, from each other, and run laterally around the width thereof. The first plurality of threads intersect the second plurality of threads at intersection points so as to define an orthogonal matrix of openings therethrough for utilization of the washing article. The first plurality of threads and the second plurality of threads are attached to each other, by knots, at the intersection points thereof for facilitating capturing of the washing article in the body by engaging therewith and for increasing the abrasiveness of the body.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention in use in a shower;

FIG. 2 is a diagrammatic perspective view of the present invention in use in a bathtub;

FIG. 3 is an enlarged diagrammatic perspective view of the area generally enclosed by the dotted curve identified by arrow 3 in FIGS. 1 and 2;

FIG. 4 is an enlarged diagrammatic top plan view taken generally in the direction of arrow 4 in FIG. 3; and FIG. 5 is an enlarged diagrammatic front elevational view of the area generally enclosed by the dotted curve identified by arrow 5 in FIG. 3.

| LIST OF REFERENCE NUMERALS UTILIZED IN THE DRAWING | |
|---|---|
| 10 | hand-held device of the present invention for scrubbing body part 12 therewith and for capturing washing article 14 therein |
| 12 | body part |
| 14 | washing article |
| 16 | body |
| 18 | pair of ends of body 16 for grabbing by hands of user |
| 20 | first plurality of threads of body 16 |
| 22 | second plurality of threads of body 16 |
| 24 | intersection points of first plurality of threads 12 of body 16 and second plurality of threads 22 of body 16 |
| 26 | orthogonal matrix of openings in body 16 for utilization of washing article 14 |
| 28 | knots attaching first plurality of threads 20 of body 16 to second plurality of threads 22 of body 16, at intersection points 24 of body 16, for facilitating capturing of washing article 14 in body 16 by engaging therewith and for increasing abrasiveness of body 16 |

DETAILED DESCRIPTION OF THE PREFERRED EMBODIMENT

Referring now to the figures, in which like numerals indicate like parts, and particularly the FIGS. 1 and 2, the hand-held device of the present invention is shown generally at 10 for scrubbing a body part 12 therewith and for capturing a washing article 14 therein.

The configuration of the hand-held device 10 can best be seen in FIGS. 3–5, and as such, will be discussed with reference thereto.

The hand-held device 10 comprises a body 16 that is slender, elongated, and generally rectangular-parallelepiped-shaped, and has a pair of ends 18 for grabbing by the hands of a user, a length, a width, and an abrasiveness.

The body 16 is tubular for capturing the washing article 14 therein and the pair of ends 18 thereof are open for inserting and removing the washing article 14 therein and therefrom.

The washing article 14 can be anything useful in a washing process, such as, but not limited to a bar of soap, a washcloth, or even both.

The body 16 comprises a first plurality of threads 20 that are parallel to each other, spaced-apart from each other, and run longitudinally along the length thereof.

The first plurality of threads 20 of the body 16 are flexible nylon.

The body further 16 comprises a second plurality of threads 22 that are parallel to each other, spaced-apart from each other, and run laterally around the width thereof.

The second plurality of threads 22 of the body 16 are flexible nylon.

The first plurality of threads 20 of the body 16 intersect the second plurality of threads 22 of the body 16, at intersection points 24, so as define an orthogonal matrix of openings 26 therethrough for utilization of the washing article 14, with each opening 26 thereof being ½"×½".

The first plurality of threads 20 of the body 16 and the second plurality of threads 22 of the body 16 are attached to each other at the intersection points 24 thereof, by knots 28 for facilitating capturing of the washing article 14 in the body 16 by engaging therewith and for increasing the abrasiveness of the body 16.

It will be understood that each of the elements described above, or two or more together, may also find a useful application in other types of constructions differing from the types described above.

While the invention has been illustrated and described as embodied in a hand-held device for scrubbing a body part therewith and for capturing a washing article therein, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand-held device for scrubbing a body part therewith and for capturing a washing article therein, comprising a body being slender, elongated, and generally rectangular-parallelepiped-shaped, and having a pair of ends for grabbing by the hands of a user, a length, a width, and an abrasiveness, wherein said body comprises a first plurality of threads that are parallel to each other, spaced-apart from each other, and run longitudinally along said length thereof, wherein said body further comprises a second plurality of threads that are parallel to each other, spaced-apart from each other, and run laterally around said width thereof, wherein said first plurality of threads of said body intersect said second plurality of threads of said body, at intersection points, so as define an orthogonal matrix of openings therethrough for utilization of the washing article, wherein said first plurality of threads of said body and said second plurality of threads of said body are attached to each other at said intersection points thereof by knots for facilitating capturing of the washing article in said body by engaging therewith and for increasing said abrasiveness of said body.

2. The device as defined in claim 1, wherein said body is tubular for capturing the washing article therein and said pair of ends thereof are open for inserting and removing the washing article therein and therefrom.

3. The device as defined in claim 1, wherein said washing article is a bar of soap.

4. The device as defined in claim 1, wherein said washing article is a wash cloth.

5. The device as defined in claim 1, wherein said first plurality of threads of said body are flexible.

6. The device as defined in claim 1, wherein said first plurality of threads of said body are nylon.

7. The device as defined in claim 1, wherein said second plurality of threads of said body are flexible.

8. The device as defined in claim 1, wherein said second plurality of threads of said body are nylon.

9. The device as defined in claim 1, wherein each opening of said plurality of openings in said body are ½"×½".

* * * * *